United States Patent [19]

Debolini

[11] Patent Number: 4,698,917

[45] Date of Patent: Oct. 13, 1987

[54] ROTARY DRIER FOR DRYING HEAT-SENSITIVE PRODUCTS AND PHARMACEUTICALS

[75] Inventor: Paolo Debolini, Turin, Italy

[73] Assignee: Italvacuum di Ing. P. Debolini & C. S.A.S., Turin, Italy

[21] Appl. No.: 858,983

[22] Filed: May 2, 1986

[51] Int. Cl.[4] ..... F26B 11/04

[52] U.S. Cl. ..... 34/92; 34/15; 34/185; 366/224

[58] Field of Search ..... 34/15, 92, 185, 108, 34/140; 366/224

[56] References Cited

U.S. PATENT DOCUMENTS

| | | | |
|---|---|---|---|
| 1,920,107 | 7/1933 | Richardson | 34/92 |
| 2,799,947 | 7/1957 | Elwess | 34/92 |
| 2,803,888 | 8/1957 | Cerletti | 34/92 |
| 2,808,657 | 10/1957 | Osborne et al. | 34/92 |
| 2,936,528 | 5/1960 | Brandl | 34/92 |
| 3,513,559 | 5/1970 | Eilenberg | 34/92 |
| 3,554,038 | 1/1971 | Sweeney et al. | 34/92 |
| 3,772,799 | 11/1973 | Yoshikawa et al. | 34/92 |

*Primary Examiner*—Albert J. Makay
*Assistant Examiner*—David W. Westphal
*Attorney, Agent, or Firm*—Sughrue, Mion, Zinn, Macpeak & Seas

[57] ABSTRACT

A vacuum rotary drier comprising a hollow body which rotates about a horizontal axis is provided with supplementary stirring devices. These devices, which are fixed to the walls of the hollow body, include a motor located outside the drying chamber and a stirring implement which rotates at high speed within the drying chamber and serves to break up lumps present in the product to be dried.

4 Claims, 2 Drawing Figures

20
18
30
22a
1
II
37
8
12
15
3
6
14
25
16
26
13
7
24
4
5
23
22b
7
17
37
30
2
8
2
21
19

7
33b
30
33
33a
38
22a
17
37
32
38
34
31
8
9
10
32
11
17

ROTARY DRIER FOR DRYING HEAT-SENSITIVE PRODUCTS AND PHARMACEUTICALS

BACKGROUND OF THE INVENTION

The present invention relates to an improved apparatus for removing solvent from bulk or finite heat-sensitive products and pharmaceuticals.

In numerous chemical processes, particularly in the pharmaceutical industry, the drying stage is often the last of a long series of individual operations; this stage is thus important both because it is carried out on a product which already has a considerable added value and because it has a notable influence on the final characteristics and appearance of the product.

The solvent-wet products normally come from a previous stage of centrifugation or filtering (filter press). It is the current practice to vacuum dry the product at the highest temperature which is permitted without the risk of thermal degradation of the product. The need of a high temperature comes from the need to reduce the drying time to acceptable values. This kind of approach to the problem of drying of the above products leads to the result that an intense and strong evaporation occurs during drying, which often causes a carry-over of the solid product's particles by the vapour flow. This carry-over could cause a clogging of the suction filters and problems as far as the vacuum pump is concerned. Moreover, when a high drying temperature is used, the product could become pasty and could need more time to be dried. Another problem, particularly when a rotary vacuum drier is used, is that the product forms particles agglomerates, referred to as "lumps" below, which, in most cases, make the dried product not suitable for the final utilization.

Therefore, the product coming from the drier needs a further granulation and milling which increases the final cost of the product itself.

After drying, the product should have as low a residual liquid content as is compatible with the optimum parameters of the operation, and should also have as uniform a grain size as possible, not only for reasons of homogeneity but particularly because a non-uniform grain size denotes the presence of the above mentioned lumps, which retain a large percentage content of liquid within them during drying and after discharge from the drier, rendering the process partially ineffective. In the drying of micro-crystalline, amorphous, fibrous or gel type organic solids in conventional rotary driers, it is noted that it is difficult to eliminate lumps from the final product. Moreover, in the case of organic solids in which the drying process is controlled by diffusion of the liquid through the solid, the duration of the process will be longer the larger the lumps.

Another problem relates to the surface layers of the particles which, whenever the drying process is controlled by the diffusion of the liquid through the solid, tend to dry more rapidly than the inner ones whereby a relatively impenetrable, dry crust is formed which prevents further drying of the interior of the particles themselves.

Accordingly, it is an object of the invention to provide a drying method for heat-sensitive products and pharmaceuticals which solves the above problems and which permits to avoid the stages of milling and/or granulation and which gives a final dried product in a powdered form.

SUMMARY OF THE INVENTION

The vacuum drying method according to the present invention is of the type comprising the step of subjecting a solvent-wet product to continuous tumbling operation in a vacuum drier apparatus provided with suction means to maintain a sub-atmospheric pressure while simultaneously with said tumbling operation. The improvement according to the present invention consists of vigorously stirring the above product with stirring means located in the tumbling path of said product, the above step being conducted in a first stage in the absence of external heat supply thereby to let the temperature of the product freely decrease as a result of latent heat removal to a temperature which is comprised in the range of 0°–40° C. above the freezing temperature of the solvent and in a second stage in which external heat is indirectly supplied thereby to maintain the temperature of the product substantially constant up to substantial drying of the product.

During the drying according to the invention, the solvent evaporation is carried out gradually avoiding the carry-over of the product. Moreover, the product does not form lumps due to the intense stirring of the product itself; in addition the product keeps friable due to the low temperature of the process and, at the end of the drying, it is in a powdered form and, in most cases, needs only a screening before the final utilization.

Driers of rotary type are used to advantage particularly for drying substances which do not tend to adhere to the walls of the drying chamber. An element common to such rotary driers is a hollow body which rotates about a horizontal axis. The hollow body may be sphere which rotates about one of its own axes or a cylinder which rotates about an axis which is inclined to its geometric axis. Another type of rotary drier is the so-called double-cone rotary direr. Rotary driers are provided with ports for the loading and unloading of the product and exchange surfaces for transmitting heat to the product.

The rotary double-cone vacuum drier according to the present invention includes at least one stirring device including a stirring implement located within the drying chamber and rotatably supported by a wall of the hollow body about an auxiliary axis of rotation distinct from the horizontal axis of rotation of the hollow body, and means for rotating the stirring implement within the said chamber.

For this purpose the stirring implement may be rotated at high speed so as to exert a considerable shearing stress, with consequent crushing both of the lumps and of any crust which forms on the surface of the particles. Thus not only is a dried product obtained which is uniform and free from lumps and in a powdered form but, for given operative parameters and a given degree of drying, the drying times are reduced.

In a rotary drier according to the present invention in which the double-cone shape results from the union of two frusti across their major bases with the interposition of a cylindrical connector, the stirring device or devices are preferably located substantially in a plane containing the axis of the frusti and perpendicular to the horizontal axis of rotation of the hollow body. This arrangement ensures that the stirring implement intercepts the flow of product even when the drying chamber is filled only to a small extent.

Further advantages and characteristics of the drying method and of the drier according to the present invention will become evident from the detailed description which follows, provided purely by way of non-limiting example, in which:

DETAILED DESCRIPTION OF THE INVENTION

Figure 1:
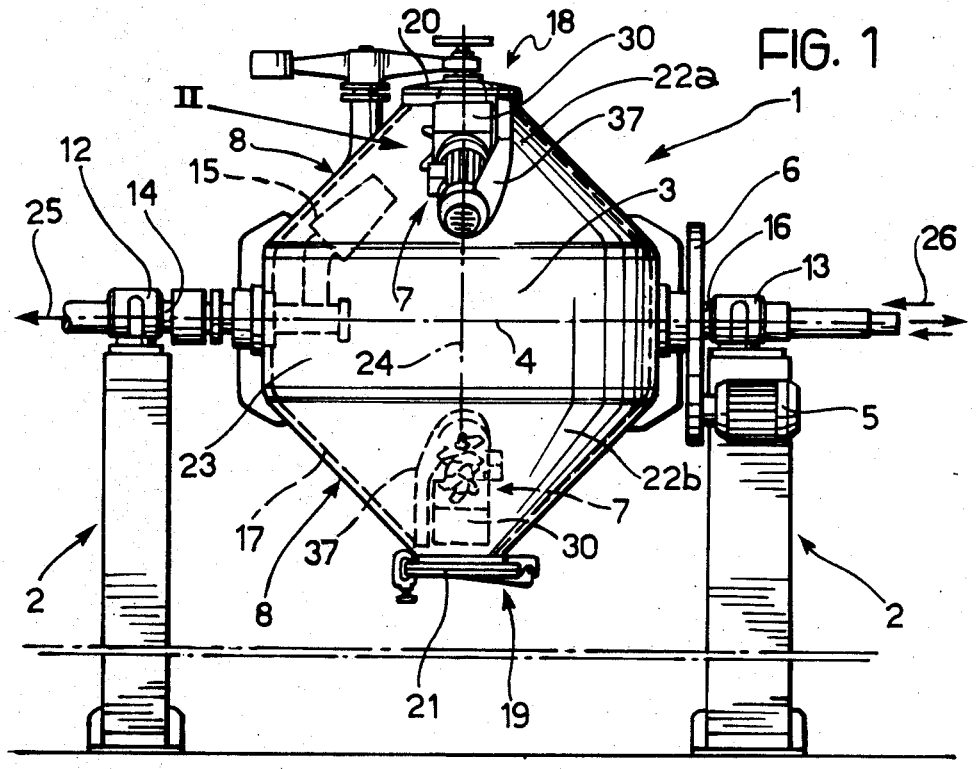
FIG. 1 is a side view of a drier according to the invention.
Figure 2:
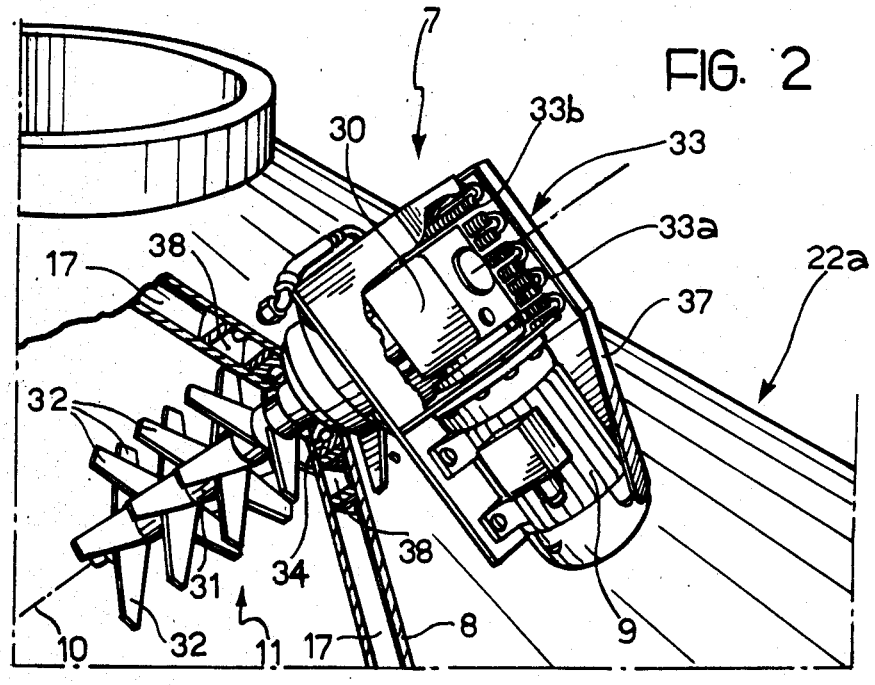
FIG. 2 is a perspective sectional view of an enlarged detail of FIG. 1.

With reference to the drawings, a vacuum rotary drier of double-cone type comprises a hollow body 1 rotatably supported by a fixed support structure 2. The hollow body 1 is formed by the union of two sheet-metal frusto-conical elements 22*a* and 22*b* across their major bases with the interposition of a cylindrical collet 23. The hollow body 1 defines a drying chamber 3 within it and has a double wall which defines an interspace 17 for the circulation of heating fluid. The hollow body 1 may be rotated about a horizontal axis 4 by means of a motor 5 fixed to the fixed support structure 2 and connected to a reduction gear 6.

The horizontal axis 4 intercepts, and is perpendicular to an axis 24 common to the two frusto-conical members 22 and to the cylindrical collet 23. Two stirring devices 7 are supported by the conical walls 8 of the hollow body and are disposed diametrally opposite each other relative to the horizontal axis 4.

The stirring devices 7 are each constituted by an electric motor 9 which, through a reductor gear 30, rotates a stirring implement 11, the form of which may vary according to the type of product to be dried, about an axis 10. Preferably, the stirring implement 11 comprises a shaft 31 having a plurality of plane blades 32 perpendicular to the shaft. The blades 32 have a lozenge shape and are angularly staggered with respect to each other along the shaft 31.

Each stirring device 7 comprises an air-cooled heat-exchanger 33 for cooling a gland 34 of the shaft 31. Each exchanger 33, supported by the reductor gear 30, comprises tubes 33*a* supplied with fins 33*b* and the air is forced across the bank of fin tubes by means of a fan driven by the electric motor 9; the air is driven through the tubes by a housing 37. The cooling fluid is circulated into annular casings 38 around the glands 34 and this circulation avoids the presence of "hot-spots" in correspondence to the glands 34 which could cause thermal degradation of the product.

The hollow body 1 is supported by the fixed support structure 2 through two bearings 12 and 13. The bearing 12 rotatably supports a hollow shaft 14 coaxial with the rotation axis 4, rigid with the hollow body 1 and communicating with the drying chamber 3 through a filter 15. The hollow shaft 14 in its turn communicates with a vacuum line 25 through which vapour produced in the drying process is extracted.

The bearing 13 rotatably supports a hollow shaft 16 coaxial with the axis 4, rigid with the hollow body 1 and communicating with the interspace 17. The hollow shaft 16 in its turn communicates with a line 26 for the vapour or, more generally, with a line for a heating fluid (hot water, diathermic fluid etc.).

The product to be dried, typically coming from a centrifuge or a filter, is loaded into the chamber 3 through a loading port 18 so that the product does not occupy more than 2/5 of the total volume of the chamber 3. After the loading port 18 has been closed by means of a door 20, the hollow shaft 14 is put in communication with the vacuum line and the motors 5 and 9 are actuated simultaneously to rotate the hollow body 1 and the stirring implements 11 respectively. The motors 5 and 9 are supplied in known manner through a rotary commutator or slip-ring rotor supported by the hollow body 1 and corresponding brushes supported by the fixed structure 2 and terminating at an electrical supply circuit (the slip ring and its brushes are not illustrated in the drawings for simplicity).

Normally the hollow body 1 rotates at a speed of between 0.5 and 5 rpm while the stirring implements 11 rotate at a higher speed of rotation, between 300 and 3,000 rpm, preferably between 500 and 1,000 rpm.

During this first stage of drying, the heating fluid is not circulated through the interspace 17, so that the temperature of the product decreases due to the evaporation of the solvent caused by the low pressure in the chamber 3.

When the product temperature reaches a value according to a predetermined pressure chosen by the operator, the heating fluid is circulated through the interspace 17 and heat is supplied to the product through the internal wall of the hollow body 1. Such predetermined pressure depends on the type of solvent and will have the nearest value to the limit of re-evaporation of the solvent in the condenser tank. The above temperature value is typically comprised in the range of 0°–40° C. above the freezing point of the solvenet. In this second stage of drying, the heat is supplied in such a way that the temperature of the product keeps constant (also the pressure keeps constant); in other words, the supplied heat balances the heat of vaporization of the solvent. To keep constant the temperature, a control system adjusts the flow rate of the heating fluid according to the set value of the pressure.

When a big amount of solvent has been evaporated, such control system is shut off and the pressure in the chamber 3 can decrease. In this third stage of drying, the heat flow supplied by the heating fluid can be the same of the heat flow during the second stage or can be higher in order to speed up the drying process. In both cases the temperature of the product is free to raise up to a predetermined value.

In the third stage of drying, the chamber 3 is connected directly to the vacuum pump by-passing the condenser, in order to avoid the re-evaporation of the solvent.

At the end of the drying process, the rotation of the hollow body 1 is stopped, the drying chamber 3 is disconnected from the vacuum line, a port 21 is opened and the dried product is discharged through a discharge aperture 19 under gravity.

The stirring implements 11 may be kept in rotation even during the discharge through the aperture 19, facilitating breakage of any "bridges" of powdered material which could form between the conical walls 8 of the chamber 3; thus the use of suitable vibrators on the conical walls is avoided, which vibrators are mounted on prior-art rotary driers.

It is understood that, the principle of the invention remaining the same, the constructional details and the embodiments may be varied widely with respect to those described and illustrated purely by way of non-limiting example, without departing from the scope of the present invention.

Thus, for example, although the rotary drier according to the invention has been described with particular reference to the drying process, this does not exclude the possibility of its use as a mixer, particularly for granular products or powders or as a filter-drier for suspensions.

I claim:

1. Rotary vacuum dryer for drying particulate material comprising:

a fixed support structure (2);

a hollow body (1) having a double-cone shape which results from the union of two frusta (22*a*, 22*b*) across their major bases with the interception of a circular cylindrical connector (23), rotatably supported about a substantially horizontal axis (4) by the fixed support structure (2) and defining a chamber (3) for the product to be dried;

means (5) for rotating the hollow body (1) about the horizontal axis (4);

at least two stirring devices including stirring implements (11) located within the chamber (3) to agitate the particulate material, said stirring devices being rotatably supported by a wall (8) of the hollow body (1), the stirring devices being substantially in a plane which contains an axis (24) of the frusta and which is perpendicular to the horizontal axis of rotation (4) of the hollow body (1); and means (9) for rotating the stirring implements (11) within the chamber (3).

2. Rotary vacuum dryer according to claim 1, in which the two stirring devices (7) are located in diametrically opposite positions relative to the horizontal axis of rotation (4) and are disposed in correspondence with the walls (8) of the two frusti.

3. A rotary vacuum dryer according to claim 2, in which each of the stirring implements (11) comprises a shaft (31) having a plurality of flat blades (32) perpendicular to the shaft (31).

4. Rotary vacuum dryer according to claim 3, further including a gland (34) interposed between the shaft (31) and the wall (8) of the hollow body (1), comprising a heat-exchanger (33, 38) for cooling said gland (34) in order to avoid local thermal degradation of the product.

* * * * *